US005533236A

United States Patent [19]

Tseng

[11] Patent Number: 5,533,236

[45] Date of Patent: Jul. 9, 1996

[54] PAPER HOLDER

[75] Inventor: Liang-Chuan Tseng, Tainan, Taiwan

[73] Assignee: Chun-Hsiung Hsu, Tainan, Taiwan

[21] Appl. No.: 512,663

[22] Filed: Aug. 8, 1995

[51] Int. Cl.[6] ..... B42F 1/00

[52] U.S. Cl. ..... 24/67.5; 24/67 R; 24/67.9

[58] Field of Search ..... 24/67.5, 67.7, 24/67.9, 67 R, 67.3, 545, 546, 346

[56] References Cited

U.S. PATENT DOCUMENTS 3,286,381 11/1966 Wooge ..... 24/67.5
4,332,060 6/1982 Sato ..... 24/67.9
4,532,680 8/1985 Hashimoto ..... 24/67.3
4,696,081 9/1987 Yen ..... 24/67.5

*Primary Examiner*—Victor N. Sakran

[57] ABSTRACT

A paper holder has a pincher made of a metal plate bent to have a triangular cross-section, and two press handles made of a metal wire bent to have a triangular portion and a nearly circular portion. The pincher has two ends in close contact and formed with two elastic semicircular hinge hooks and another semicircular hook between the two hooks for a bottom side of each press handle to be pushed therein with the triangular portion of each press handle to rest thereon. Then the two press handles can be pressed down to let the bottom sides of the pincher to open for papers to be inserted and pinched therein after the press handles are released.

1 Claim, 5 Drawing Sheets

PAPER HOLDER

BACKGROUND OF THE INVENTION

This invention concerns a paper holder, particularly able to be assembled together with quickness and easiness.

A conventional paper holder shown in FIGS. 1 and 2, comprises a pincher 1 formed of a metal plate bent to have a triangular cross-section, and two press handles 13, 13' combined together.

The pincher 1 has two lips 10, 10' at its mouth and two circular hinges 11, 12; 11', 12' extending outward from the the two lips 10, 10'. the two hinges 11, 12; 11', 12' respectively have a pointed projection 110, 120; 110', 120'.

The two press handles 13, 13' are made of a metal wire respectively bent to have a curved portion and two leg portions respectively provided with a bent outward foot 130, 130'; 131, 131'. Those feet are respectively inserted in a related circular hinge 11, 12, 11' or 12, with the leg portions resting on outer surfaces of the pincher 1. Then the two press handles 13, 13' may be pressed down against each other, forcing the lips 10, 10' of the pincher 1 to open outward so that sheets of papers can be inserted in the opening and pinched therein after the two press handles 13, 13' are released.

However, the press handles 13, 13' have such a shape that there is an opening between the two feet 130, 130'; 131, 131' so that they cannot be placed without tangling with each other in storing. And they have to be separated from one another before they are to be combined with the pincher 1.

SUMMARY OF THE INVENTION

This invention has been devised to offer a paper holder including grip handles of a different shape from the conventional one, not tangling with each other in storing.

The main feature of the present invention is two press handles formed with a nearly circular portion and a triangular portion of two legs respectively provided with bent-inward feet having their ends to almost contact with each other separated by a small gap. Then each press handle is endless, without possibility of tangling with one another in storing.

BRIEF DESCRIPTION OF DRAWINGS

The invention will be better understood by reference to the accompanying drawings, wherein.

DETAILED DESCRIPTION OF THE INVENTION

Figure 1:
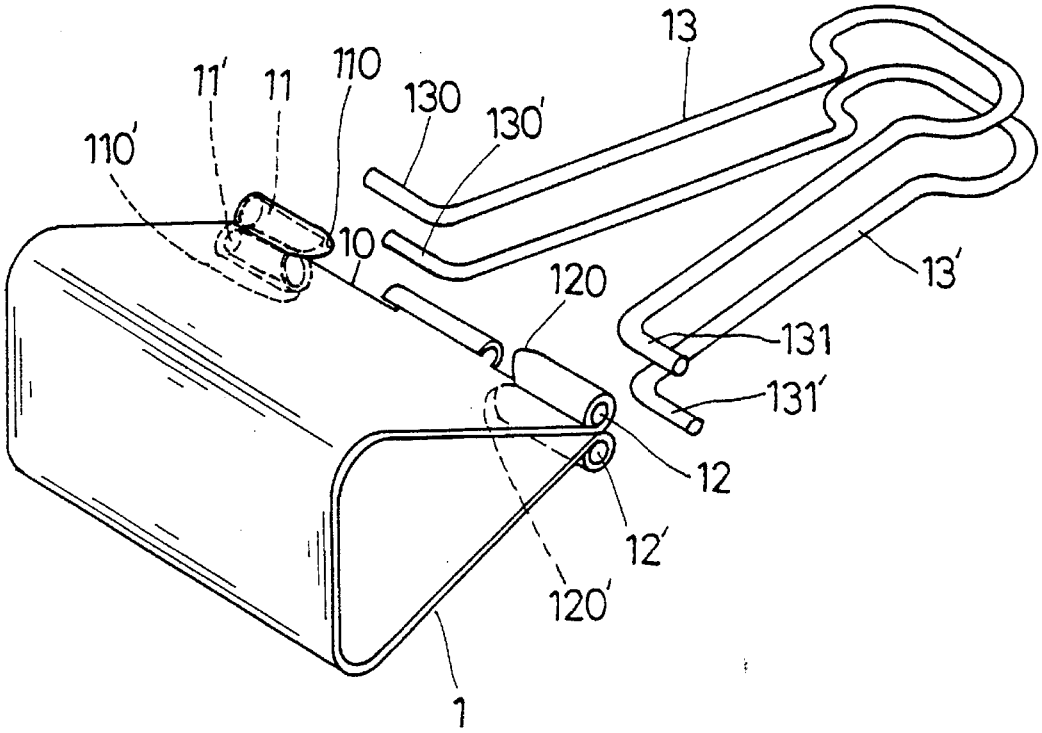
FIG. 1 (PRIOR ART)
FIG. 1 is an exploded perspective view of a conventional known paper holder.
Figure 2:
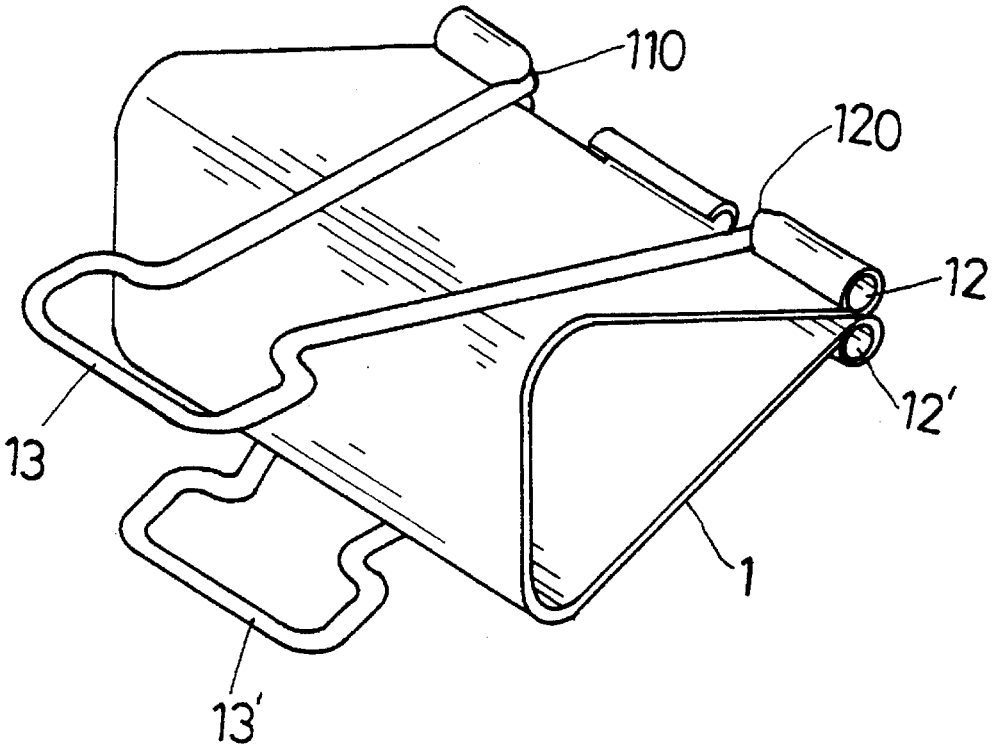
FIG. 2 (PRIOR ART)
FIG. 2 is a perspective view of the conventional known paper holder in FIG. 1.
Figure 3:
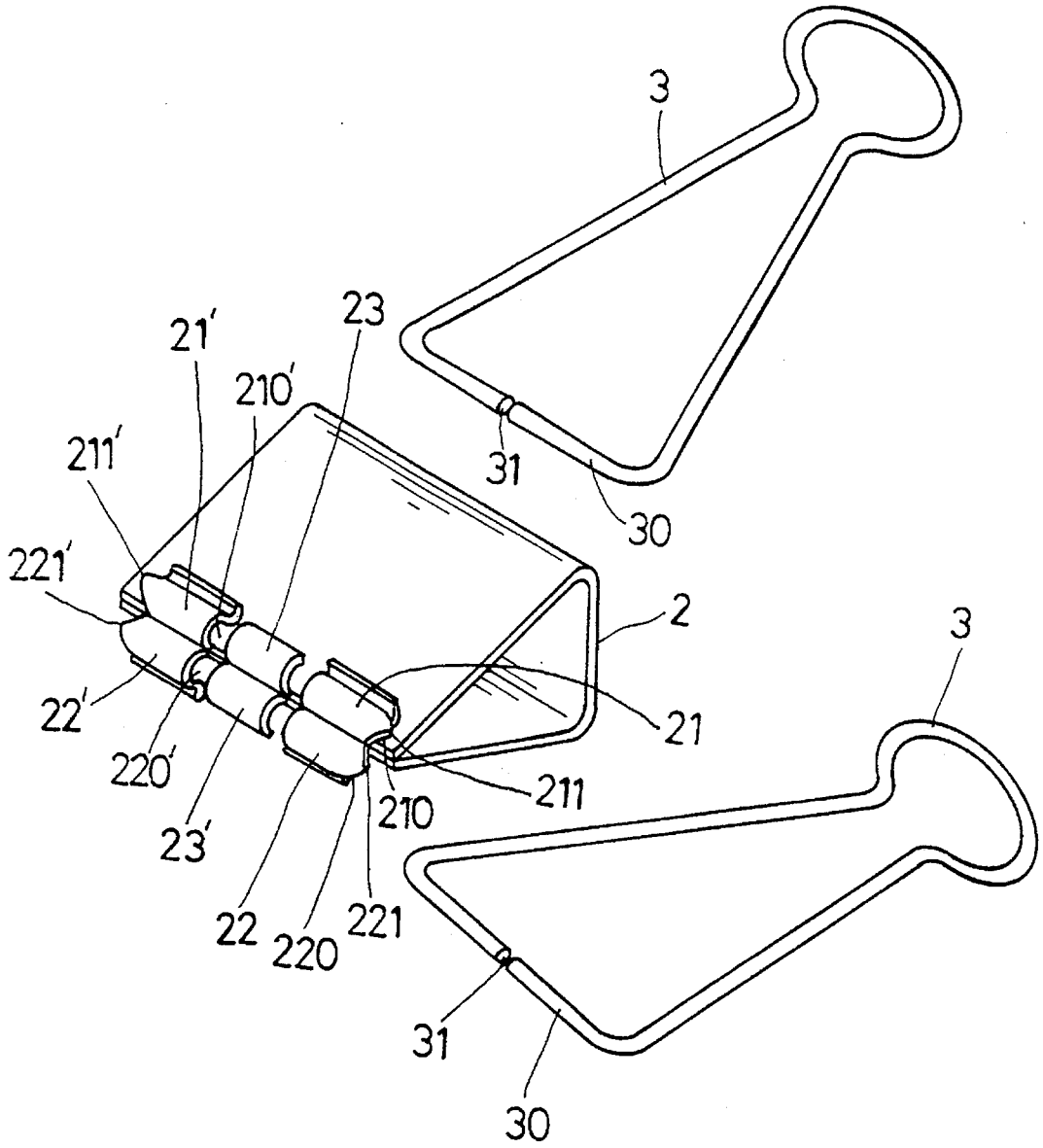
FIG. 3 is an exploded perspective view of a paper holder in the present invention.

A paper holder in the present invention, as shown in FIG. 3, comprises a pincher 2 with a triangular cross-section, and two press handles 3, 3 combined together.

The pincher 2 is formed of a rectangular metal plate bent into a triangular cross-section, having two ends in close contact with each other. Each end of the pincher 2 respectively has a pair of elastic semicircular hinge hooks 21, 21'; 22, 22' at two sides, and another semicircular hinge hook 23; 23' formed between each pair of the hinge hooks 21, 21'; 22, 22'. Each elastic semicircular hinge hook 21, 21'; 22 or 22' has a semicircular groove 210, 210'; 220 or 220', and a pointed projection 211, 211'; 221, or 221' formed at an outer end thereof.

Each of the two press handles 3 is formed of a metal wire, shaped to have a triangular portion and a nearly circular portion connected with the triangular portion, namely shaped as shown in FIG. 3. Each press handle 3 has a straight horizontal bottom 30 with a small gap 31 formed between two ends of the material.

Figure 4:
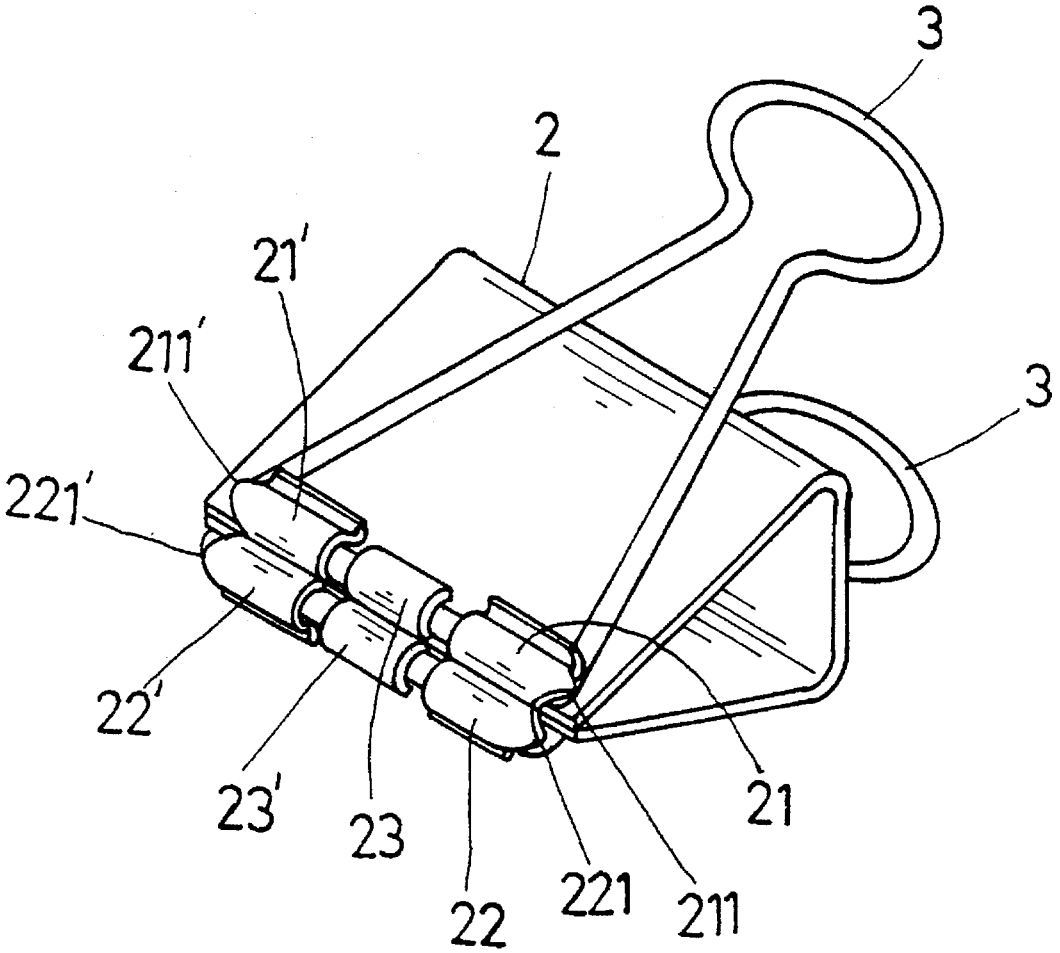
FIG. 4 is a perspective view of the paper holder in the present invention; and, FIG. 5 is a perspective view of the paper holder in the present invention, showing press handles turned for 180.

In assembling, the bottoms 30, 30 of the two press handles 3, 3 are forcefully pushed in the semicircular grooves 210, 210'; 220, 220' of the two pairs of the elastic hinge hooks 21, 21'; 22, 22' of the pincher 2 as shown in FIG. 4, with the triangular portions of the press handles 3, 3 resting on the outer surfaces of the pincher 2 in a pinching position.

Figure 5:
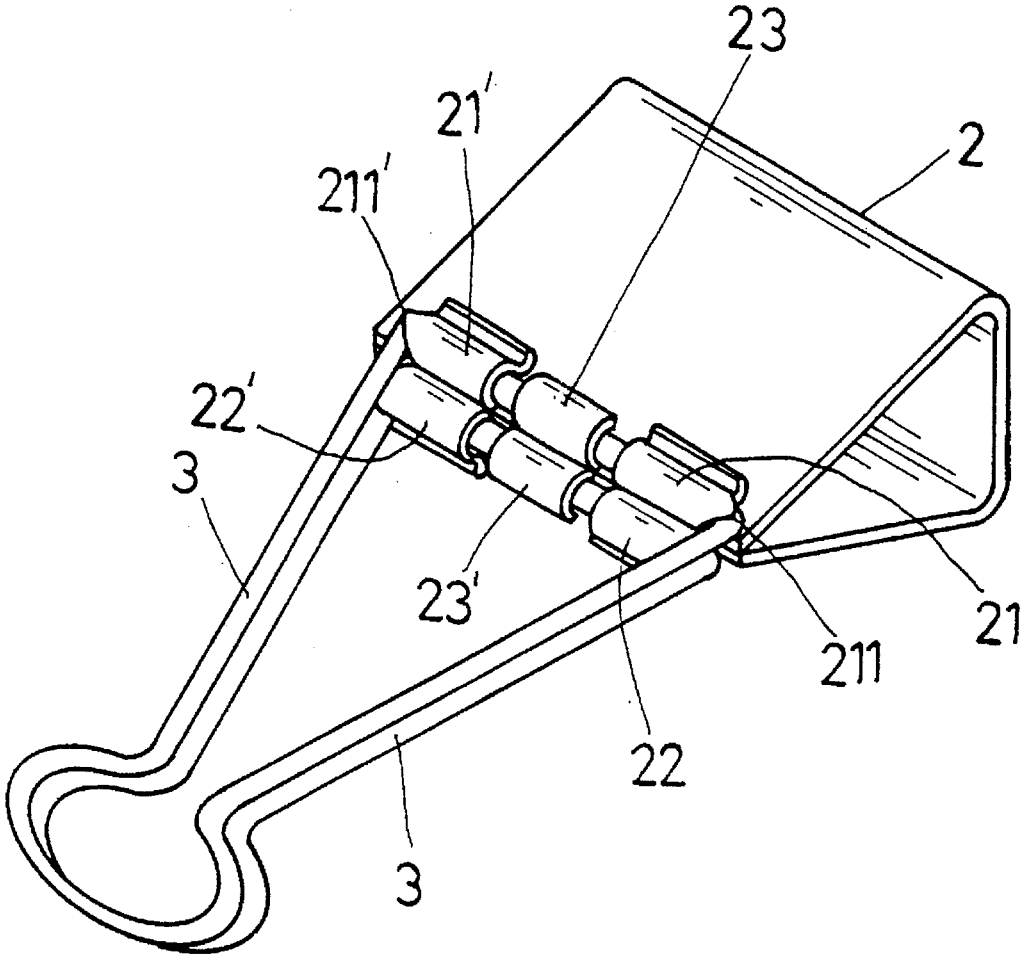

In using, the circular portions of the press handles 3, 3 are pressed down against each other manually, letting the two ends together with the hinge hooks 21, 21'; 22, 22' of the pincher 2 open outward to form an opening for sheets of paper to be inserted and pinched therein after the press handles 3, 3 are released. Further, the pointed projections 211. 211'; 221, 221' of the hooks 21, 21'; 22, 22' firmly contact with two corners of the bottoms 30, 30 of the two press handles 3, 3, keeping the same secured in the pinching position. And if the two press handles 3, 3 are swung from the pinching position for almost 180 to a released position wherein the two press handles 3, 3 come to contact with each other as shown in FIG. 5, also secured in that position by the pointed projections 211, 211'; 221, 221' tightly.

As can been seen from the above description, this paper holder has advantages as follows.

1. The grip handle is shaped as shown FIG. 3, having no ends to hook and tangle with one another, more convenient than the conventional one.
2. It can be combined with more easiness than the conventional one.

While the preferred embodiment of the invention has been described above, it will be recognized and understood that various modifications may be made therein and the appended claims are intended to cover all such modifications which may fall within the spirit and scope of the invention.

What is claimed is:

1. A paper holder comprising a pincher and two press handles combined together, said pincher formed of a rectangular metal bent in a triangular cross-section and having its two ends in close contact with each other, each said end of said pincher having two elastic semicircular hinge hooks at both sides rolled outward and another semicircular hinge hook between said two elastic semicircular hinge hooks, each of said two elastic semicircular hinge hooks having a pointed projection at an outer end, each said press handle formed of a metal wire bent to have a triangular portion and a nearly circular portion extending from the triangular portion, said triangular portion having a bottom side formed with two ends of the metal wire separated with a small gap, said bottom sides of said two grip handles being forcefully pushed into said semicircular grooves of said semicircular hinge hooks of said pincher, with said triangular portions of said press handles resting on two outer surfaces of said pincher in a pinching position so that said two grip handles may be pressed down against each other letting the bottom sides of the pincher open outward for sheets of paper to be inserted and pinched therein after said press handles are released.

* * * * *